United States Patent [19]

Carter et al.

[11] Patent Number: 4,627,662

[45] Date of Patent: Dec. 9, 1986

[54] TILTING MECHANISM FOR A CHAIR

[75] Inventors: David E. Carter, Hemel Hempstead; Malcolm J. Bailey, Newport Pagnell; Brian A. Willatts, Milton Keynes, all of England

[73] Assignee: Pledge Office Chairs Limited, London, England

[21] Appl. No.: 719,282

[22] PCT Filed: Aug. 8, 1984

[86] PCT No.: PCT/GB84/00272

§ 371 Date: Apr. 3, 1985

§ 102(e) Date: Apr. 3, 1985

[87] PCT Pub. No.: WO85/00734

PCT Pub. Date: Feb. 28, 1985

[30] Foreign Application Priority Data

Aug. 9, 1983 [GB] United Kingdom ..... 8321400
Oct. 17, 1983 [GB] United Kingdom ..... 8327750

[51] Int. Cl.[4] ..... A47C 3/00
[52] U.S. Cl. ..... 297/313; 297/300
[58] Field of Search ..... 297/300, 328, 313, 366, 297/367

[56] References Cited

U.S. PATENT DOCUMENTS 3,712,666 1/1973 Stoll ..... 297/313 X
3,975,050 8/1976 McKee ..... 297/328
4,067,533 1/1978 Kazaoka et al. ..... 297/328 X
4,364,605 12/1982 Meiller et al. ..... 297/300 X
4,408,800 10/1983 Knapp ..... 297/300 X
4,471,994 9/1984 Zünd et al. ..... 297/300
4,537,445 8/1985 Neuhoff ..... 297/300

FOREIGN PATENT DOCUMENTS 0056454 7/1982 European Pat. Off. .
2501674 7/1975 Fed. Rep. of Germany .
47809 9/1978 Fed. Rep. of Germany ..... 297/300
8301562 5/1983 PCT Int'l Appl. .

*Primary Examiner*—Peter A. Aschenbrenner
*Attorney, Agent, or Firm*—Holman & Stern

[57] ABSTRACT

A tilting mechanism for a chair includes a stationary support frame member for connection to an upright chair column, a seat frame member for mounting a seat portion of the chair, and a backrest frame member for mounting a backrest portion of the chair. The seat frame member defines a downwardly directed channel and respective horizontal pivots between parallel sides of the channel to pivotally mount the seat frame member to the support frame member, and the backrest frame member to the seat frame member, allowing the tilt of the seat and the backrest to be adjusted. The support frame member and the backrest member are connected by links to respective toothed quadrant members pivotally mounted in the channel. Locking levers in the channel are biased normally to lock the quadrants in position, but a control lever with a cam device thereon is operable to release either or both locking levers from the quadrants when adjustment of the tilt of the seat or backrest is required, the cam device lifting one or both locking levers against their bias depending on the position of the control lever.

10 Claims, 16 Drawing Figures

TILTING MECHANISM FOR A CHAIR

CROSS REFERENCE TO RELATED APPLICATION(S)

This United States application stems from PCT International Application No.PCT/GB84/00272 filed Aug. 8, 1984.

This invention relates to an improved tilting mechanism for a chair of the kind disclosed in our P.C.T. Application Number PCT/GB82/00307 (Early published No. WO 83/01562).

In said PCT application the chair has a seat portion to the underside of which is secured a frame part having a socket member into which the top of a conventional support post of the chair is fitted. To the seat portion, a backrest part is pivotally connected so that by pivotting the backrest relative to the seat portion the angle between the backrest and seat portion can be varied. A mechanism is described for allowing said required degree of tilt and for locking the backrest in the desired position relative to the seat portion.

However in recent times doctors have expressed the opinion that an arrangement where the backrest is tiltable to a fixed seat portion could be disadvantageous because of the fixed position of the seat portion irrespective of the angle of the backrest. If with the seat portion horizontal, a person sitting on the chair leans forward, the person's stomach muscles become compressed and the muscles at the rear of the thighs become stretched. However if the seat portion of the chair could tilt to accommodate the person's action in leaning forward, such harmful muscle compression and stretching could be avoided.

An object of the invention is thus to provide a tilting mechanism for a chair, which, in use, allows the seat portion to tilt.

According to the invention there is provided a tilting mechanism for a chair comprising a first part for connection, in use, to a seat portion of the chair, a second part, for connection, in use, to a backrest portion of the chair, and a third part for connection, in use, to a base of the chair, said first and second parts being pivotally connected together for relative pivotal movement about a horizontal axis, in use, said first and third parts being pivotally connected together by a horizontal axis so that said first part can move pivotally, in use, about said third part, and there being means for adjusting the relative angular positions of the first and second parts, and the first and third parts, and for releasably locking them in said chosen relative angular positions.

Figure 1:
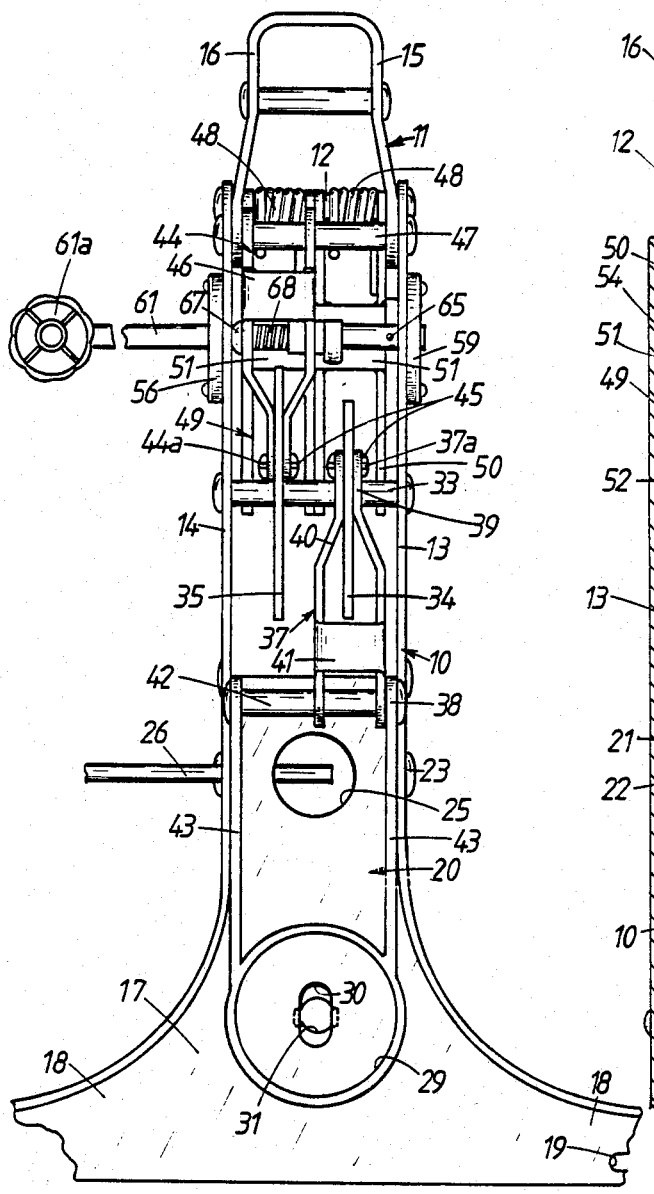
Figure 2:
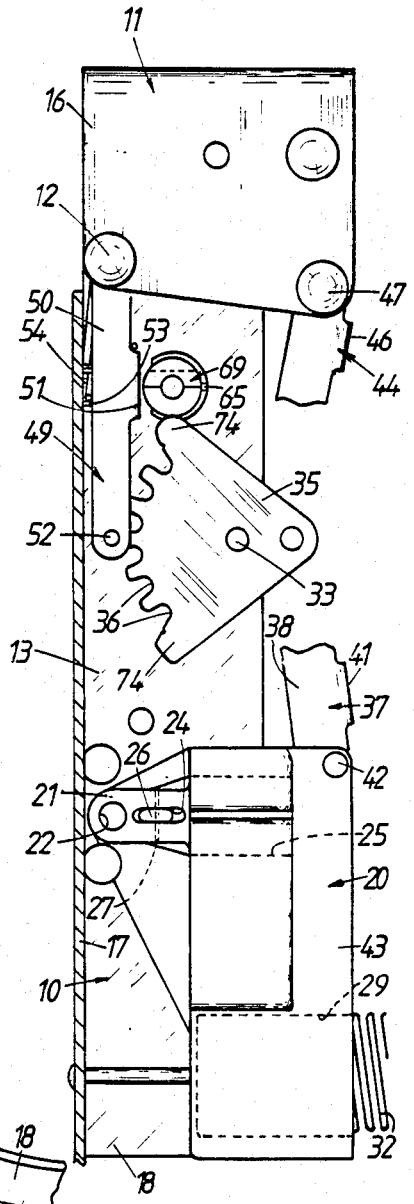
Figure 2A:
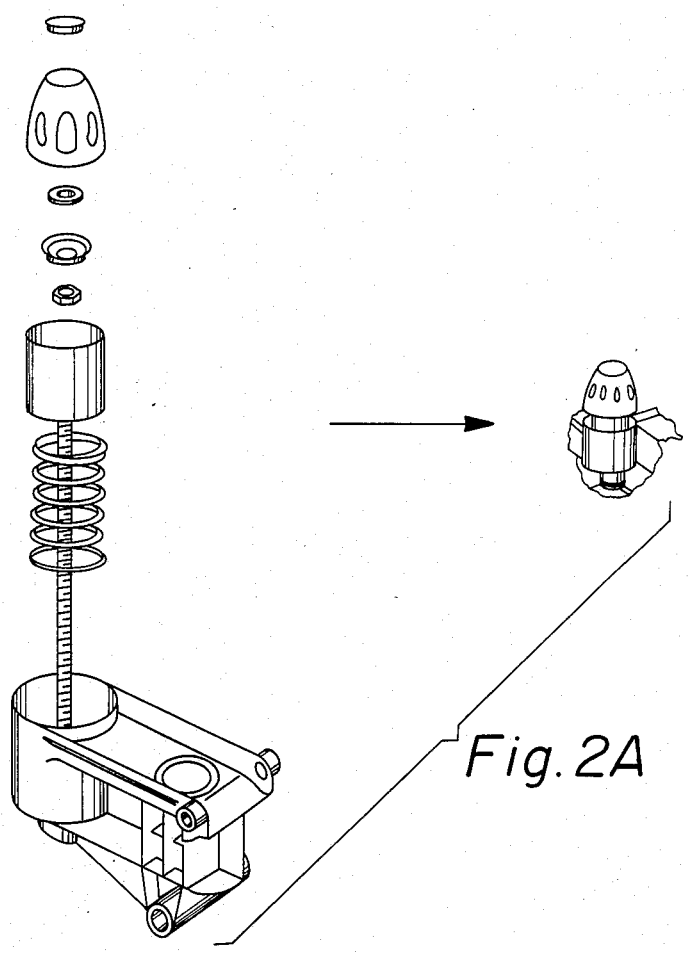
Figure 3:
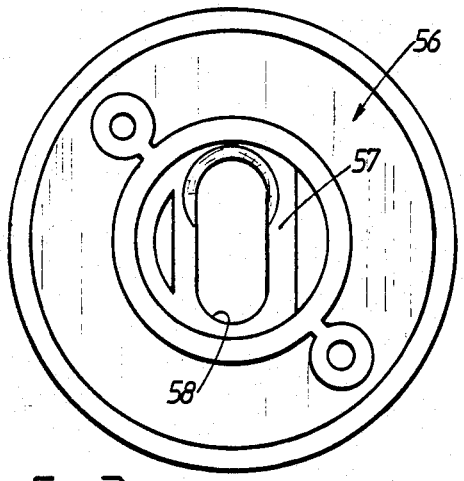
Figure 5:
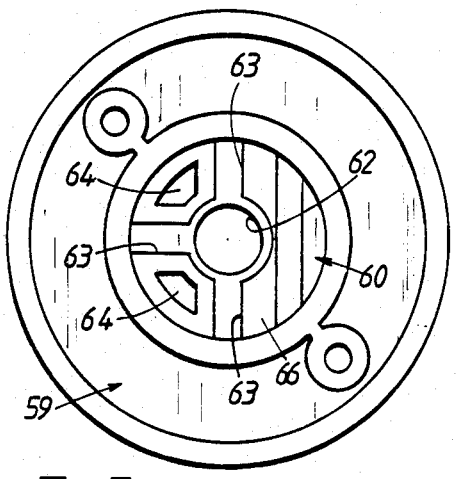
Figure 4:
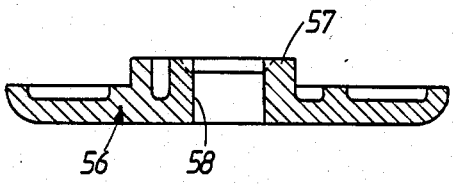
Figure 6:
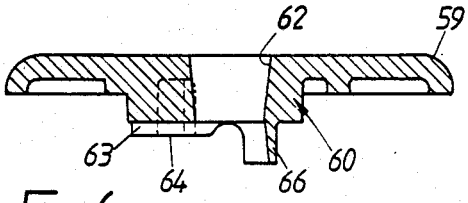
Figure 7:
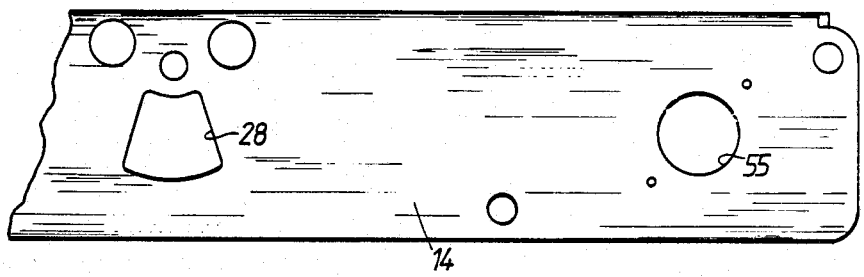
Figure 8:
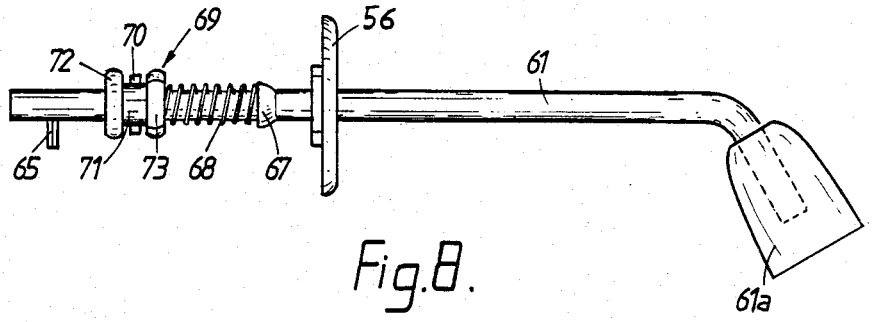
Figure 9A:
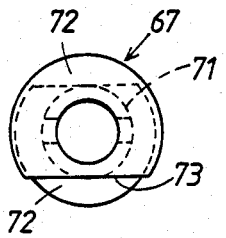
Figure 9B:
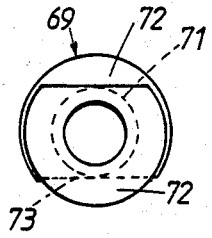
Figure 9C:
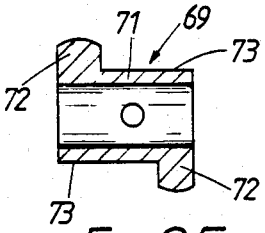

The invention will not be described, by way of example, with reference to the accompanying drawings, in which:

FIG. 1 is a schematic underneath view of part of a tilting mechanism of the invention, FIG. 2 is a schematic, fragmentary view with one side of the mechanism removed, FIG. 3 is a front view of a key plate which is disposed at one side of the mechanism for controlling a manually operable lever for adjusting the tilt of the chair seat and/or the backrest, FIG. 4 is a section through the key plate of FIG. 3, FIG. 5 is a front view of an index plate which is disposed at the other side of the mechanism also for controlling said lever, FIG. 6 is a section through the index plate of FIG. 5, FIG. 7 is a fragmentary view of one side of the mechanism, FIG. 8 is a view of the manually operable tilt adjusting lever, together with the key plate, a spring cup, a compression spring, a cam and an index pin for controlling said adjustment, FIGS. 9A to 9C are opposite end views and a longitudinal sectional view of the cam of FIG. 8, and FIGS. 10A to 10C show alternative positions of the cam as the tilt adjusting lever is operated.

The type of chair to which the mechanism of the present invention is usually applied is that conventionally referred to as a typists' chair. Such a chair is illustrated in FIG. 1 of our PCT application referred to in the introduction to the specification. As shown therein the chair has a base comprising a multiplicity of castor-supporting legs extending radially outwardly from the bottom of an upright cylindrical support column. At the top of the column there is a conventional gas-spring height adjustment means for raising or lowering a seat of the chair in accordance with the user's requirements. A backrest of the chair is connected to the seat by means of an oval section of tube. By way of the tube, the backrest is spaced above and somewhat behind the seat. In addition to the facility for vertical adjustment, the column may have provision for rotary movement relative to the part of the base formed by the legs.

FIGS. 1 and 2 of the present application show a frame 10 on which an upholstered seat pad would be fitted. This frame constitutes a first part of the mechanism. The oval section of tube connecting the backrest to the seat of the chair can be adjusted vertically to alter the position of the backrest in a vertical direction relative to the seat. This adjustment facility is provided by way of a resilient sleeve surrounding the tube. The sleeve is carried in a bracket 11 in which is engaged a locking bar. The bar has a head at one end and an operating lever portion at the other end. Within the bracket 11, which is of generally U-shaped configuration as shown in FIG. 1, the locking bar has an eccentric portion which can engage and press against the sleeve and thus trap the oval section tube. Locking and unlocking are carried out by an overcentre action and the bar engages in the bracket 11 through enlarged holes at opposite sides of the bracket 11 to allow freedom of movement of the bar in its released position. The bracket 11 is therefore normally secured relatively to the backrest, but the latter can be adjusted in the vertical direction as described.

The frame 10 which carries the seat is an elongated inverted channel and the bracket 11 is pivotally connected to the frame by means of a horizontal pivot pin 12 extending through registering holes in side flanges 13, 14 of the frame 10 and side flanges 15, 16 of the bracket 11. The bracket 11 constitutes a second part of the tilting mechanism.

At the opposite end of the channel of the frame 15, the side flanges 13, 14 and a base 17 of the channel are splayed outwardly to provide a pair of lateral arms 18. In the portion of the base 17 forming the arms 18, there are provided a pair of slots for securing the frame 10 to the underside of the seat pad of the chair. One of these slots 19 is partly shown in FIG. 1. The base 17 can be provided with other appropriate means for enabling it to be secured to the chair seat.

A third part of the tilting mechanism of the invention is shown in FIGS. 1 and 2, where it is in the form of a pivot block 20. The pivot block 20 can be a casting, or can alternatively be produced by any other suitable means such as moulding. The pivot block has an upwardly extending ear 21 with a hole 22 extending therethrough. This hole 22 is aligned with registering holes in the side flanges 13, 14 of the frame 10, and a horizontal pivot pin 23 extends through the flanges 13, 14 and through said hole 22. Below the hole 22, a slot 24 extends through the ear 21. The slot 24 breaks into the upward extension of a cylindrical opening 25 which extends upwards from the bottom of the pivot block 20 where it is open. In use, the upper end of a conventional gas spring height adjuster is fitted in the opening 25, so that thereby the pivot block 20 is fixed relative to the base of the chair. A manually operable lever 26 extends through the slot 24 into the opening 25 so that it is positioned above the top of the gas spring height adjuster. The lever 26 is pivotally mounted by means of a small pin 27 in the ear 21 disposed transverse to the slot 24. Thus by pivoting the lever 26 up and down, the height adjuster can be operated to raise or lower the pivot block 20 and thus the chair. The flange 13 or 14 through which the lever 26 extends, has a suitable cut-out portion 28 (FIG. 7) to accommodate relative pivotal movement between the frame 10 and pivot block 20 as will be described.

The end of the pivot block 20 adjacent the splayed side flanges 13, 14, is provided with a further downwardly open cylindrical opening, indicated by the numeral 29 in FIGS. 1 and 2. The top of the opening 29 is closed except for a longitudinally disposed slot 30. This is positioned directly below a generally transverse slot 31, the transverse sides of which have generally rounded centre portions. In use a coiled compression spring 32 sits in the opening 29, and on its lower end is a disc with a central hole therethrough. Around the disc is a bellows-type cover, and a bolt passes through the slots 30, and 31 and extends through the hole in the disc. The head of the bolt is engaged against the upper surface of the base 17 at said rounded sides of the slot 31. The threaded end of the bolt is screw-threadedly engaged with threads formed on an internal spigot formed in a manually operable knob. Thus by rotating the knob on the bolt, the coil spring compression can be adjusted. Thus as will be described the force required to pivot the seat relative to the base, i.e. the frame 10 relative to the pivot block 20 can be varied as required merely by rotating this adjustment knob in the appropriate direction to increase or decrease the compression of the coil spring.

Secured between the flanges 13, 14, and disposed approximately midway along the channel is a horizontal pivot pin 33. This can be secured in position by appropriate circlips or other fastening means. The pivot pin 33 carries thereon for pivotal movement therewith, two quadrant members 34, 35 respectively, each quadrant member being disposed vertically in the channel and parallel to the flanges 13, 14 thereof. The quadrant member 34 is disposed nearer the side flange 13 whilst the quadrant member 35 is disposed near the side flange 14. The upper edge of each gradrant member faces the base of the channel and is formed with a series of recesses or teeth 36 lying along an arc of which the centre coincides with the pivot pin 33. A pair of levers 37 on a pivot pin **37*a* contact opposite sides of the quadrant member 34. Each lever is made up of a first straight part 38 connected to the part 39 on the pin 33 by a short step portion 40. The first two straight parts 38 are parallel and spaced apart, being interconnected by a short integral lug 41. The straight parts 38 are pivotally connected on a horizontal pivot pin 42 secured between spaced flanges 43 at the bottom of the pivot block 20, the flanges 43 each lying parallel to the flanges 13, 14 of the frame 10. Thus relative angular movement between the pivot block 20 and frame 10 about the pivot pin 23 will be transmitted through the levers 37, which thus act as a link, to the quadrant member 34**. As will be described this quadrant member can be locked into a chosen position, thereby similarly locking the angular relationship between the frame and the pivot block, i.e. between the seat part of the chair and the base thereof.

Similarly with the quadrant member 35, levers 44 identical with the levers 37 are pivotally secured to the quadrant member by a pivot pin **44*a*. In this example the pivot pins 37*a* and 44*a* pass through the quadrant member at a position remote from the recesses 36 and behind the pivot pin 33. As shown in the drawings each pivot pin 37 passing through the levers and the quadrant member is secured in position by retaining caps 45. The levers 44 are, as mentioned, identical to the levers 37 and are thus interconnected by a lug 46 of the same form as the lug 41. The ends of the levers 44 remote from the quadrant 35 are pivotally connected on a horizontal pivot pin 47 secured between the side flanges 15, 16 of the bracket 11. Around the pivot pin 12 are a pair of axially spaced coiled torsion springs 48, with one limb of each engaging the pivot pin 47 and the other limb of each engaging the interior surface of the base 17 of the channel. This thus biases the bracket 11 to a rest position relative to the frame 10, just as the spring 32 biasses the pivot block 20 to a rest position relative to the frame 10**.

It can be appreciated from FIG. 2 how angular movement of each quadrant will occur substantially within the channel of the frame 10. Moreover although the pivotal connections of the levers 37 and 44 to the pivot block 20 and bracket 11 respectively are below the side flanges of the frame 10, relative angular movement will tend to swing the bracket 11 and/or pivot block 20 into the channel thereby keeping the arrangement very compact.

Along the base 17 of the channel of the frame 10, are provided a pair of two armed links 49. Each two armed link comprises a pair of straight arm portions 50 which are relatively spaced apart and are parallel to the side flanges of the frame. At the centre of each link the two arm portions are connected together by a flat lug 51. At one of its ends, each link is pivotally connected on the pivot pin 12 with one of said torsion springs 48 being disposed between its two arm portions. At its opposite end, a cylindrical pin 52 interconnects the two arm portions, this pin being of a size and shape to allow it to be received into any one of the recesses or teeth 36 of a quadrant member 34, 35. FIG. 2 shows an arrangement where the pin 52 is between recesses of the quadrant 35. Relative movement of the bracket 11 to the frame 10 will cause corresponding movement of the quadrant 35 so that the pin 52 becomes aligned with a recess or tooth 36 in which it can then engage to lock the parts 10 and 11 in a relative angular position. Extending upwardly from each lug 51 is a hollow cylindrical housing 53 which contains a compression spring 54. One end of the spring 54 bears against the base 17 of the channel whilst the other end of the spring bears against the lug 51. The spring is held in position by way of the housing 53. These springs 54 thus serve to bias the links 49 downwardly into engagement with the respective quadrant members. Thus although as will be described it is possible to release the links 49 from engagement with the quadrant members to allow adjustment of the backrest and/or seat to be made, force must be applied to lift these links against the springs 54 so that on release of this force the links are biased again to lock the quadrant members in position. Thus accidental disengagement is extremely unlikely, and even if the springs 54 were to fail after a long period of continued use, the links 49 would still be urged by gravity into engagement with the quadrant members.

FIG. 7 shows the side flange 14 of the frame 10 and in particular the cut-out portion 28 through which the lever 26 projects, in use. It can be seen that at the opposite end of the flange there is provided a circular hole 55. Around this hole is secured by means of screws, a circular key plate 56 shown in FIG. 1 and in detail in FIGS. 3 and 4. The key plate 56 is screwed to the flange 14 so that a D-shaped inwardly projecting part 57 extends into and is received in the hole 55. The part 57 has a central vertical elongated slot 58. The slot 58 is enlarged outwardly at its upper end towards the base 17, for a purpose to be descibed. Preferably the part 57 is made of plastics material. The two flanges of the frame are in fact identical so that at the opposite side of the frame 10, there is a further circular hole corresponding to the hole 55. Secured by screws to this flange 13 is an index plate 59 shown in FIG. 1 and in detail in FIGS. 5 and 6. A central circular part 60 of the plate 59 projects into and is received in the circular hole in the flange 13. This part 60 has a central circular opening 62 to receive a circular-section manually-operable lever 61 for releasing the links 49 from the quadrants 34, 35. Extending radially from the opening 62 are three generally semicircular grooves 63. One of the grooves extends vertically downwardly from the opening 62 whilst the other two extend horizontally in opposite directions from the opening 62, all the grooves extending to the periphery of the circular part 60. Between the vertical groove and each horizontal groove is a cam surface 64. As will be described the slots receive a pin 65 carried by the end of the lever 61. Above the horizontal slots there is formed a downwardly directed abutment wall 66 to help direct the pin 65 into one of the horizontal slots upon rotation of the lever 61 as will be described. The circular part 60 is preferably made of plastics material.

FIG. 8 shows the lever 61 and also the key plate 56 through which it passes. Carried on the lever 61 is a plastics spring cup 67 into which one end of a compression spring 68 is received. The other end of the spring 68 abuts an end surface of a plastics-material cam 69 securely fixed to the lever 61 by a pin 70. As already described a pin 65 is secured to an end of the lever so as to project at right angles therefrom. The pin is of a length slightly greater than the length of a groove 63.

The cam 69 is shown in detail in FIGS. 9A and 9C. As can be seen the cam has a cylindrical centre portion 71 with narrower larger diameter cylindrical portions 72 at either side thereof. However each portion 72 is cut-away to provide a flat 73, the two flats lying parallel to each other but being at opposite sides of the cam 69. Moreover the plane containing the flat also contains the outer periphery of the adjacent surface of the centre portion 71 as can be seen from FIG. 9C.

The spring cup 67 is slidable on the lever 61 and is shaped and sized to be received in the upper enlarged part of the slot 58. The lever is pivotally mounted between the side flanges 13, 14 with its end received in the index plate 59, as shown in FIG. 1. With the lever pivoted downwardly, the spring cup bears against the inwardly facing surface of the part 58 as it is slightly too large to be fully received in the slot 58. In this position it compresses the spring 68 against the fixed cam. The lever is mounted in the channel so that with the knob 61A of the lever directed vertically downwardly, the pin 70 is disposed in the vertically downwardly disposed groove 63 and the flats 73 are also disposed vertically downwardly. The lever will be at an angle relative to the horizontal base 17, since it is received in the lower part of the slot 58. In this position the upper surface of one of the portions 72 is in light contact with its associated lug 51 (FIG. 10A), whilst the other portion 72 is out of contact with its associated lug, so that the cam does not raise the links 49 against their springs. As the lever 61 is pivotally mounted in the index plate 59, it can be rotated through 90° to the front or to the rear of the mechanism whilst still remaining in the lower part of the slot 58. Such rotation causes the pin 65 to move out of the vertically downwardly directed groove into the one of the horizontal grooves 63 facing the direction of movement of the lever 61. Rotation of the lever 61 causes the pin 65 to ride over an adjacent cam surface 64 before it reaches the appropriate groove 63, and this movement over the cam surface causes the lever, and thus the cam 69 to move towards the flange 14, thereby compressing the spring 68. Once the pin 65 reaches the horizontal groove 63, it is forced into it by the compression of the spring as it now expands.

As long as the lever 61 remains in the lower part of the slot 58 in the key plate 56, the portions 72 of the cam 69 will not raise either of the links 49 against their associated springs 54 so that with the pins 52 of the links 49 engaged with the quadrant members 34, 35 respectively, movement of the lever 61 by way of its knob 61A will not disturb the locked positions of the backrest and the seat. However the lever can be positioned whilst it is in the lower part of the slot 58 so that it is ready to be moved upwardly when adjustment of the tilt of the backrest and/or the seat is required.

Figure 10A:
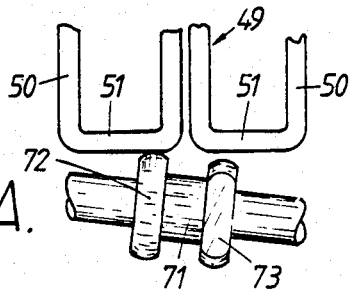
Figure 10B:
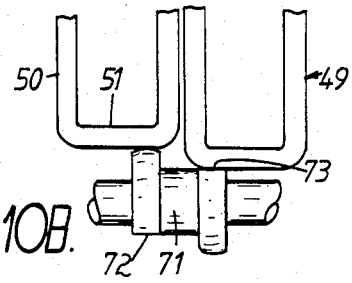
Figure 10C:
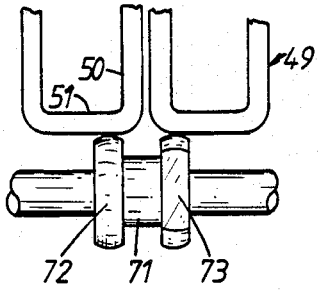
Figure 10D:
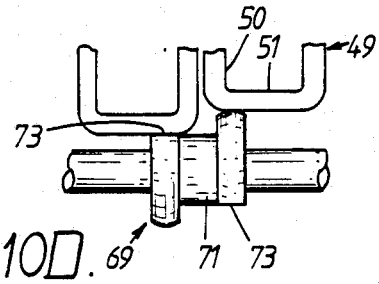

Thus for example if the lever is in the lower part of the slot 58 with its knob 61A directed vertically downwardly, it is possible by raising the lever by way of its knob to bring the lever into the upper enlarged portion of the slot 58. This brings the lever to a generally horizontal position as shown in FIG. 10C. As the spring cup 67 can be received in the enlarged portion of the slot 58, it moves into this portion thereby slightly releasing the tension on the spring 68. At the same time cylindrical upper surfaces of the portion 72 are moved upwardly in contact with the lugs 51 against their associated springs 54, thereby pivoting the links upwardly about the pivot pin 12. In this position the flats 73 on the portion 72 are disposed vertically and out of engagement with the lugs 51. This pivoting of the links 49 causes the pin 52 of each link to move upwardly out of engagement with a recess in its associated quadrant member. Accordingly the user of the chair can now alter the relative position of the backrest to the seat, and of the seat to the pivot block 20, and thus of the base of the chair. With the handle in this raised position there is thus a free-floating arrangement. The backrest can be moved by the user pushing rearwardly against it, against the action of the torsion springs 48, which tend to return it to a generally upright position. Similarly the user can press downwardly on the rear of the seat to move it against the action of the compression spring 32 which tends to return the seat to a generally downwardly tilted position. Thus if it is wished to adjust both the seat and the backrest together, it is possible to arrange the lever in the lower part of the slot 58 with the knob directed vertically downwardly. When adjustment is actually required, it is thus merely then a simple matter to raise the lever, returning it to its lower position once adjustment has been effected, whereupon the links 49 are released so that their respective pins 52 engage with the quadrant members in the adjusted positions. However with the mechanism of this invention it is also possible to adjust the backrest or the seat independently of one another. This is accomplished by rotating the lever 61 by way of its knob 61A, to substantially 90° from the vertical position described, so that it is directed either towards the pivot block 20 or to the bracket 11. If for example it were to be directed to the bracket 11, when in its raised position, or directed towards the bracket 11 and then raised in the slot 58, the 90° rotation causes, as already mentioned, the pin 65 to move into the groove 63 also directed towards the bracket 11. This rotation of the lever causes associated rotation of the cam 69, so that the flat on the portion 72 nearer the flange 13 is directed upwardly to the lug 51, whilst for the portion 72 nearer the flange 14, its cylindrical surface is directed upwardly with its flat being directed downwardly. Thus when the lever is raised to its upper position, the flat 73 on the portion 72 adjacent the flange 13 contacts its associated link 49 but does not force it upwardly against its associated spring. Thus the quadrant 34 remains engaged by its associated link 49 and pin 52 so that it cannot be adjusted. However the circular surface of the cam portion 72 nearer the flange 14 pushes the link 49 upwardly by way of its lug 51 against the compression 54, thereby releasing the associated pin 52 from engagement with the quadrant member 35. Thus the bracket 11 can be pivoted on its pivot pin 12 relative to the frame 10, with the quadrant member 35 swinging on the pivot pin 33. As already described this movement can be produced by the user of the chair by applying force to the backrest against the torsion springs 48. When the required adjusted position is reached for the backrest, the lever 61 is preferably moved downwardly, thereby releasing the link 49 and once more locking the quadrant member 35 in position. FIG. 10D schematically shows the arrangement with links 49 and cam 69 with this adjustment of the backrest, these being viewed looking along the channel from the pivot block along the downwardly open channel towards the bracket 11.

It will be appreciated that in a similar manner it is possible to adjust the seat relative to the base of the chair by rotating the lever through 90° in the opposite direction from the vertically downwards position. In a similar manner, and as shown schematically in FIG. 10B, the other link is now depressed by the cylindrical upper surface of the portion 72 nearer the flange 13, with the other link remaining in its lower unpivoted position. Thus the quadrant member 34 is now released to allow the seat to be pivoted relative to the pivot block 20 fixed to the base of the chair. Again when adjustment is complete the lever is preferably moved downwardly so that the quadrant member 34 is re-engaged by its associated pin 52 of its link 49. It will be appreciated that once adjustment of the backrest is made, it would be possible merely to rotate the lever through 180° whilst still keeping it in its raised position thereby enabling adjustment of the seat to be carried out immediately thereafter. However once the seat had been adjusted it is necessary to move the lever to its lower position, so that the two now adjusted positions can be locked.

Although in this example the quadrant members are pivoted on a common pivot axis, each quadrant member could have its own pivot, with each quadrant member still being operated by one of the links 49, even though both links 49 could still be operated by a single cam and lever mechanism.

It will be appreciated that the cut-out portion 28 shown in the flange 14 is sufficient to allow the maximum pivotal movement of the frame 10 relative to the pivot block 20 which is allowable with the particular construction of the mechanism. In this regard each quadrant member generally has upward projections 74 at each end of the arcuate row of recesses. The projection 74 are of such a height as to engage a pin 52 even when it is in its raised position, thereby limiting the permitted swinging movement of a quadrant member. The frame 10 can be symmetrical about its longitudinal axis so that the levers 26 and 61 can be mounted at either side of the mechanism as required, and with once lever at either side instead of both at one side as shown in this example.

Thus the mechanism of the invention allows efficient and easily operable means for adjusting the tilt of both the backrest and the seat. However the mechanism remains compact with substantially all of the components being pivotable in the confines of the channel. Thus when the frame 10 defining the channel is secured to the underside of the chair the whole arrangement is unobtrusive and compact and is thus believed aesthetically pleasing. Moreover as described it will be appreciated that the adjustment mechanism is simple and easy to operate and allows the lever 61 to be positioned ready for upward movement when a tilting operation is required. Thus the lever can be placed in anyone of three positions in its lowermost part of the slot 58, being raised when the tilting operation is to take place. Alternatively the lever can just as easily be raised and then rotated, if necessary, to the required position to allow the required amount of tilting. It is believed that the free-floating arrangement in which both the chair seat and the backrest can be adjusted independently of one another but at the same time is particularly convenient and time saving.

We claim:

1. A tilting mechanism for a chair comprising (a) a seat frame member for mounting a seat portion of the chair thereon, said seat frame member defining an inverted channel including a base and parallel side flanges, (b) a backrest frame member for mounting a backrest portion of the chair thereon, a first horizontal axis extending between said parallel side flanges, said backrest frame member being pivotally mounted on said first horizontal axis for movement towards or away from said inverted channel, (c) a support frame member for mounting on a base part of the chair, a second horizontal axis extending between said parallel side flanges, said seat frame member being pivotally mounted on said second horizontal axis for movement about said support frame member, (d) a first quadrant member pivotally mounted between said parallel side flanges for movement in a plane parallel to said side flanges, an upper edge of the first quadrant member, a plurality of recesses in said upper edge of the first quadrant member, a first link means pivotally connected between said backrest frame member and said first quadrant member converting pivotal adjustment movement of the backrest frame member into pivotal movement of the first quadrant member, (e) a second quadrant member pivotally mounted between said parallel side flanges for movement in a plane parallel to an upper edge of the second quadrant member, a plurality of recesses in said upper edge of the second quadrant member, said side flanges, a second link means pivotally connected between said support frame member and said second quadrant member converting pivotal adjustment movement of the seat frame member into pivotal movement of the second quadrant member, (f) two locking levers disposed along the base and between the side flanges of the inverted channel, each locking lever having a free end and being mounted for pivotal movement between the side flanges, the respective free ends of the two locking levers being releasably engageable with recesses of the first and second quadrants respectively thereby to lock each of the quadrants in a selected pivotal position, (g) a control lever mounted on the seat frame member for rotation to a number of set positions, the control lever extending beneath both of said locking levers, a manually operable portion of the control lever, said manually operable portion extending to one side of the seat frame member, cam means on the control lever, the cam means including respective cam portions selectively engageable with the locking levers in said set positions of said control lever, a first set position of the control lever corresponding to one of the locking levers being raised by a cam portion to be out of engagement with said first quadrant, while the second quadrant remains engaged by its locking lever, and a second set position of the control lever corresponding to the other locking lever being raised by the other cam portion to lie out of engagement with the second quadrant, while the first quadrant remains engaged by its locking lever, free pivotal adjustment movement of the backrest frame member with the seat frame member being fixed being possible in said first set position, and free pivotal adjustment movement of the seat frame member with the backrest frame member being fixed being possible in said second set position, both the backrest and seat frame members being lockable in a selected position after adjustment by means of the locking levers and quadrants.

2. A mechanism as claimed in claim 1, comprising a pivot pin, each locking lever being pivotally mounted between the side flanges on said pivot pin about which the backrest frame member is pivotally mounted on the seat frame member, biasing means, each locking lever being biassed by said biasing means downwardly towards its associated one of the quadrants.

3. A mechanism as claimed in claim 1, comprising a downwardly directed opening in said support frame member, a coil spring received in said opening, a threaded bolt extending from the seat frame member through said opening and inside the coil spring, and adjustment means engaged with the bolt for adjusting the position of engagement of the adjustment means along the length of the bolt and thus adjusting the compression of the spring.

4. A mechanism as claimed in claim 1, comprising a torsion spring, a first end of the torsion spring, a second end of the torsion spring, said torsion spring being on said first horizontal axis, said first end engaging the seat frame member and said second end engaging the backrest frame member and thus biasing the backrest frame member away from said inverted channel.

5. A mechanism as claimed in claim 1, comprising a third set position of the control lever where the free ends of both locking levers respectively are released from the quadrants to allow the backrest frame member and the seat frame member simultaneously to pivot freely and independently.

6. A mechanism as claimed in claim 5, comprising the control lever being pivotally mounted between the side flanges of the seat frame member, the pivotal mounting allowing the control lever to be moved downwardly from any one of said three set positions, the downward movement releasing any force exerted by the cam means on the locking levers, which with the control lever moved downwardly engage with the quadrants respectively.

7. A mechanism as claimed in claim 5, comprising means defining an aperture at one of the side flanges, an index plate mounted at said aperture, means defining a central aperture in the index plate, a first groove in the index plate, said first groove extending radially vertically downwardly from said central aperture, second and third grooves in said index plate, the second and third grooves extending radially from said central aperture in opposite directions each at ninety degrees to the first groove, an end of the control lever, an indexing pin connected to the end of the control lever, the end of the control lever being received in said central opening in the index plate, cam surfaces between the first groove and the second and third grooves respectively, rotation of the control lever between said three set positions causing the indexing pin to move between the three grooves by riding over said cam surfaces.

8. A mechanism as claimed in claim 7, comprising means defining an aperture at the other of the side flanges, a key plate mounted at said aperture in the other of the side flanges, means defining an opening in the key plate, said opening in the key plate receiving said control lever therethrough, a compression spring on the lever, a first end of the compression spring, a second end of the compression spring, a spring cup slidably received on the lever, one end of the compression spring engaging the spring cup, the other end of the compression spring engaging the cam means on the control lever, rotation of the control lever causing the compression spring to be compressed by sliding movement of the spring cup as the indexing pin rides over said cam surfaces, and released when the indexing pin is received in one of said first second or third grooves.

9. A mechanism as claimed in claim 1, comprising a first downwardly directed engagement surface on one of the locking levers, a second downwardly directed engagement surface on the other of the locking levers, the cam portions of the cam means on the control lever being spaced apart along the control lever to be aligned with said first and second engagement surfaces, each cam portion having a cylindrical surface interrupted by a flat, a first side of the cam means on the control lever, a second side of the cam on the control lever opposite to said first side, the flats of the two cam portions respectively lying parallel to each other on said opposite sides of the cam, rotation of the control lever to the first or second set positions disposing the flats horizontal with the flat on one cam portion engaging its aligned locking lever but not lifting it from engagement with its quadrant, and the flat on the other cam portion facing away from the other locking lever which is lifted by part of the remaining cylindrical surface of the other cam portion.

10. A mechanism as claimed in claim 8, comprising an upper enlargement in the opening in the key plate, the enlarged opening receiving the spring cup which is biased into said enlarged opening under the force of the compression spring when the control lever is in one of its set positions.

* * * * *